United States Patent [19]

Lonze

[11] Patent Number: 4,474,108

[45] Date of Patent: Oct. 2, 1984

[54] ALUMINUM CAN COMPRESSOR DEVICE

[76] Inventor: Robert F. Lonze, 1044 Thyra La., Palatine, Ill. 60067

[21] Appl. No.: 380,134

[22] Filed: May 20, 1982

[51] Int. Cl.[3] ..... B30B 9/32

[52] U.S. Cl. ..... 100/45; 100/215; 100/218; 100/902

[58] Field of Search ..... 100/45, 215, 216, 266, 100/902, 218; 241/99

[56] References Cited

U.S. PATENT DOCUMENTS

| | | | |
|---|---|---|---|
| 2,619,150 | 11/1952 | Smith | 100/215 X |
| 2,813,569 | 11/1957 | Nelson | 100/266 X |
| 3,412,675 | 11/1968 | Killough et al. | 100/902 X |
| 3,817,169 | 6/1974 | Bischoff | 100/216 X |
| 3,907,087 | 9/1975 | Tanaka | 100/902 X |
| 3,916,780 | 11/1975 | Heiser | 100/902 X |

*Primary Examiner*—Billy J. Wilhite
*Assistant Examiner*—Christine A. Peterson
*Attorney, Agent, or Firm*—Hill, Van Santen, Steadman & Simpson

[57] ABSTRACT

An automatic can crushing machine, preferably used for compressing standard aluminum 12 ounce beverage cans, is constructed of a housing having an angularly inclined feed chute for receiving a supply stack of cans to be crushed therein and an adjacent, parallel-arranged crushing station in which a piston reciprocates back and forth to crush the cans one at a time delivered from the feed chute. The feed chute is adapted to contain a serial stack of spent cans which are disposed, under the influence of gravity, to pass downward in the chute toward an ejection end. An ejector mechanism in the form of a plunger passes transversely through the ejection end of the chute to force a can about to be crushed through a delivery opening covered by a flap valve for deposit into a trough mounted in the crushing station. A crushing piston reciprocates within the trough. Movement of the crushing piston along the trough longitudinally compresses the can to approximately one-eighth of its original length over an outlet gap. When the piston begins it retraction stroke in the trough, the crushed can product is released and falls freely through the outlet gap into a suitable disposal receptacle. A leaf spring is positioned along the feed chute above the ejection end so that subsequent cans in the stack are disposed out of line with the can being ejected and, thus, tilting or nesting of the can being ejected is prevented.

10 Claims, 6 Drawing Figures

10
11
12
13
14
15
16
17
18
22
23
25
26
27
28
29
30
31
32
33
35
37
38
39
40
43
44
46
48
A
B
II
III

ALUMINUM CAN COMPRESSOR DEVICE

BACKGROUND OF THE INVENTION

The invention relates to apparatus which automatically flattens or crushes aluminum beverage cans in the longitudinal direction, thereby converting the cans into a compact disposable product which is easier to package or otherwise handle.

Retail eating establishments, such as bars or restaurants, typically accumulate a large volume of spent aluminum cans, usually beverage cans, within short periods of time. These cans must be disposed of or packaged for recycling. Since a large number of spent cans takes up an inordinate amount of space, frequently attempts will be made to manually crush some or more of the spent cans to compact the volume they must take up in a garbage or recycling station located at the establishment.

The task of manually compacting the spent cans is time-consuming and represents an inefficient use of personnel. Furthermore, the process of manually crushing cans is frequently imprecise such that optimal compacting of the disposal space taken up by the cans is normally not achievable. Also, the manual crushing of cans can represent a safety hazard, especially in the event that one or more cans rupture or become distorted with sharp edges.

The present invention is directed to an automatic apparatus in which aluminum cans can be reliably crushed to an optimally compact residue at relatively high-speed and without risk of endangering the safety of the operator. As a result of the operation of the inventive machinery, less space is required to be set aside for spent aluminum cans at the user establishment.

SUMMARY OF THE INVENTION

An automatic can crushing machine is formed with a relatively compact housing having an angularly inclined feed chute formed with an upper end inlet of a predetermined diameter such that twisted or distorted cans or oversized cans cannot be inadvertently fed into the machine. A can deposited into the feed chute slides down to the bottom and engages an actuating switch.

An ejector mechanism mounted along one side of the feed chute includes a motor-driven crankarm connected to a plunger which passes laterally into the chute to force the can through a sidewall flap out of the chute into a crushing station. Within the crushing station, there is mounted a reciprocable ram for longitudinally compressing the can against a stationary wall. The compressed can is in the form of a compacted end product approximately one-eighth the original size of the can. When the actuating switch is engaged, the ram compresses a can in the crushing station and then retracts. The crushed end product falls out of the crushing station through an outlet into a disposal receptacle, such as a plastic bag or the like.

When the ram retracts, a further actuating switch is triggered which engages the ejector mechanism motor causing the plunger to eject the can disposed at the bottom end of the chute into the crushing station. The next can in the feed chute indexes to the bottom to engage the actuating switch there and repeat the process.

The feed chute can accept a plurality of cans disposed one on top of the other. The can at the ejection end of the chute is disposed out of alignment with the rest of the cans. This prevents it from nesting with the next adjacent can and twisting or canting during ejection into the crushing station. To this end, a leaf spring is mounted in the feed chute maintaining the penultimate can off line from the can to be ejected.

DESCRIPTION OF THE PREFERRED EMBODIMENT

Figures 1, 2:
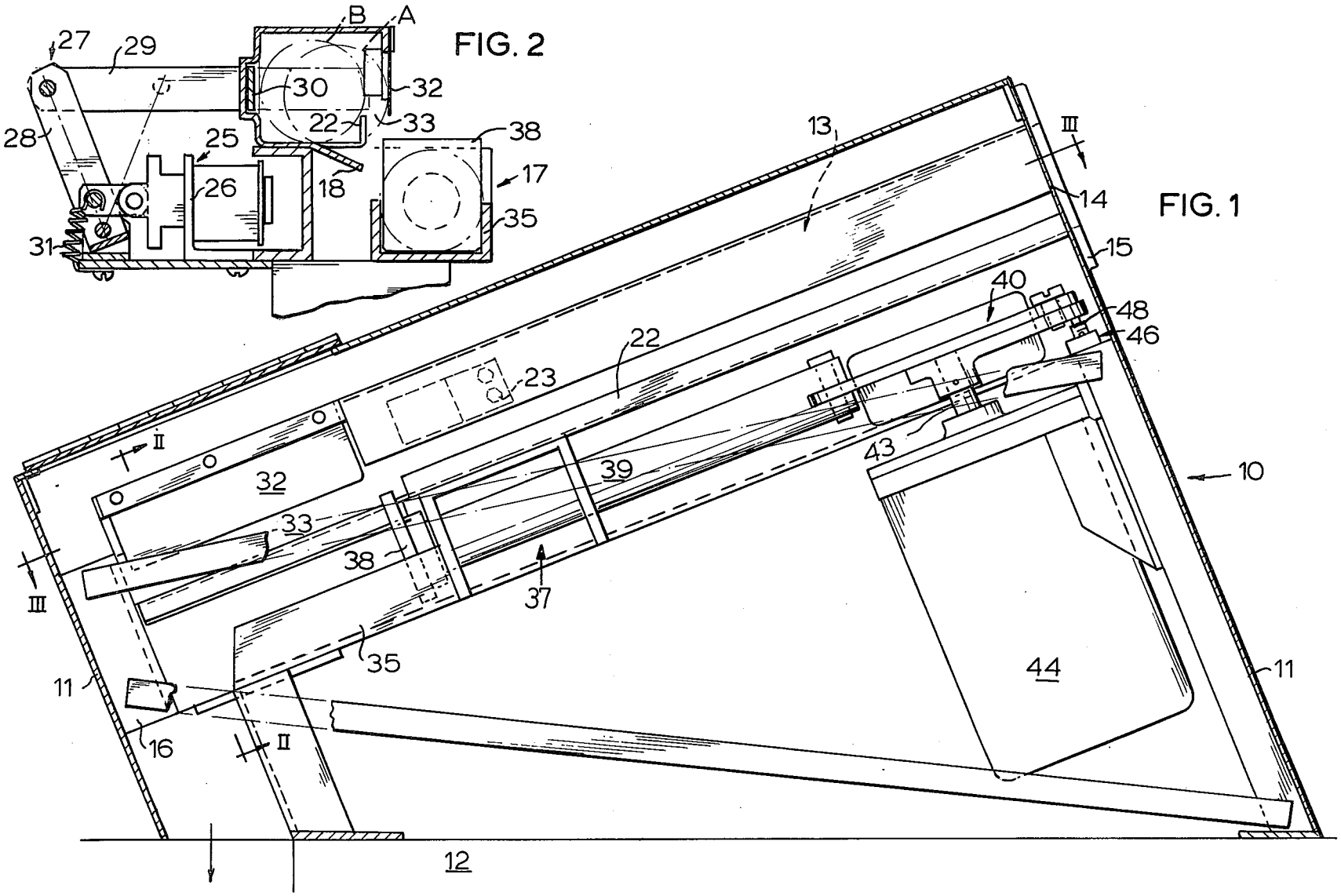
FIG. 1 is a cross-sectional, side elevational view of a can crushing machine constructed in accordance with the present invention.
FIG. 2 is a fragmentary, cross-sectional view taken along the lines II—II of FIG. 1.
Figure 3:
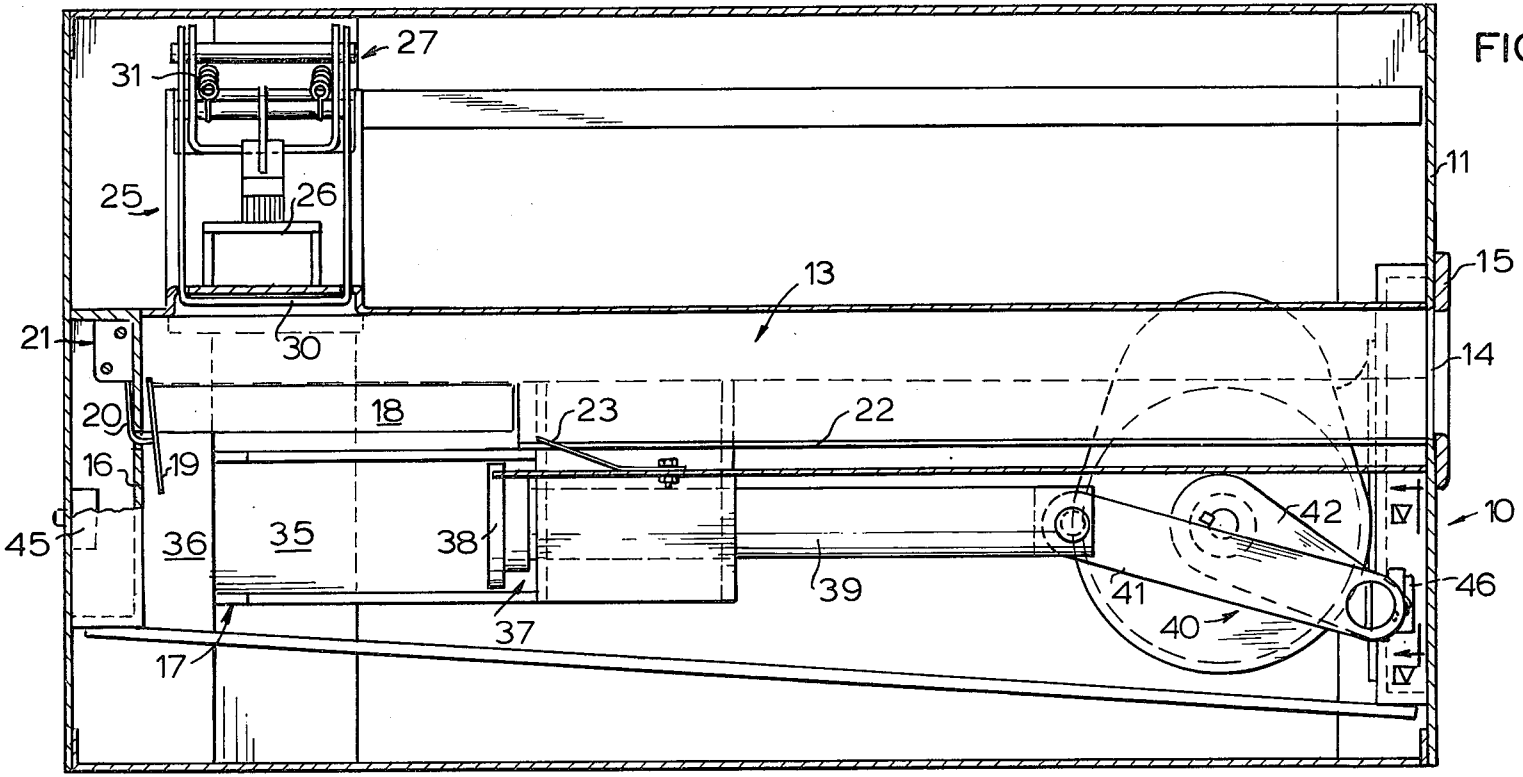
FIG. 3 is a cross-sectional view taken along the lines III—III of FIG. 1.

FIGS. 1 and 3 illustrate an automatic can crushing machine 10 having a substantially enclosed housing 11 suitably supported on a flat surface, such as a table or bench top 12. The longitudinal axis of the housing 11 is disposed along an angular incline from the horizontal. Extending substantially the entire length of the housing 11 is an angularly inclined feed chute 13 adjacent the upper end of the housing.

The feed chute is formed at its upper end with an inlet opening 14 into which emptied aluminum cans, typically 12 ounce soft-drink and beer cans, are inserted end to end one at a time for passage down the feed chute 13 into the machine 10. An aluminum ring 15 is mounted along the exterior of the inlet opening 14 having a central hole of predetermined diameter such that twisted or otherwise distorted cans or oversized cans cannot be inadvertently fed into the machine and thereby jam the mechanism. In this manner, the ring 15 serves as a control on the size and shape of cans the machine can handle. The lower end of the feed chute 13 is an ejection area closed off by a planar wall 16 which extends transversely out of the feed chute and into an adjacent crushing station 17 disposed beneath the feed chute 13. The bottom wall of the feed chute 13 adjacent its lower end is formed with a downwardly angled plate 18 having a length slightly greater than the length of a normal 12 ounce beverage can. The plate 18 faces toward the discharge station 17 and causes cans to readily pass from the lower, ejection end of the feed chute into the crushing station, as will be further described below.

Disposed along the end wall 16 within the feed chute 13, there is mounted a longitudinally displaceable abutment plate 19 connected at one end of an arm 20, the other end of which is pivotally mounted in an actuating switch means 21. When a can reaches the lower end of the feed chute 13, the abutment plate 19 is engaged by the can and depressed, causing the actuating switch to be engaged.

A sidewall guidetrack 22 is formed along the length of the feed chute between the inlet 14 and the upper end of the angled plate 18. This guidetrack 22 is of a width and incline sufficient to permit 12 ounce aluminum cans to freely slide down the feed chute under the influence of gravity along a common pathline. Mounted along one sidewall of the feed chute 13 and extending transversely into the pathline of the guidetrack 22 is a steel leaf spring flap 23. The leaf spring 23 is secured at its upper end to the sidewall and formed with a free lower end which slants progressively into the interior of the chute 13 in the downward inclined direction. The free end of the leaf spring 23 terminates above the upper end of the angled plate 18 and serves to press against the penultimate can in the chute stack to assure it from canting in the guidetrack 22 or nesting when the bottommost can is being ejected into the crushing station.

Due to the guidetrack 22 and leaf spring 23, the sequential stack of cans arranged in the feed chute are disposed along a common longitudinal axis down of the chute 13 one on top of the other slightly transversely out of line with the can in the ejection area which has its longitudinal axis closer to the crushing station 17. As a result of this shifting, the bottommost can may be passed transversely out of the feed chute 13 into the crushing station 17 without interference by the next higher can in the stack, such as by engaging in nested relationship with that can. Once the bottommost can is dispensed from the feed chute 13, the next higher can automatically passes, under the influence of gravity, into the vacated lower end of the chute 13, since the spring force of the leaf 23 is insufficient to hold a can against downward travel in the chute 13.

Figure 6:
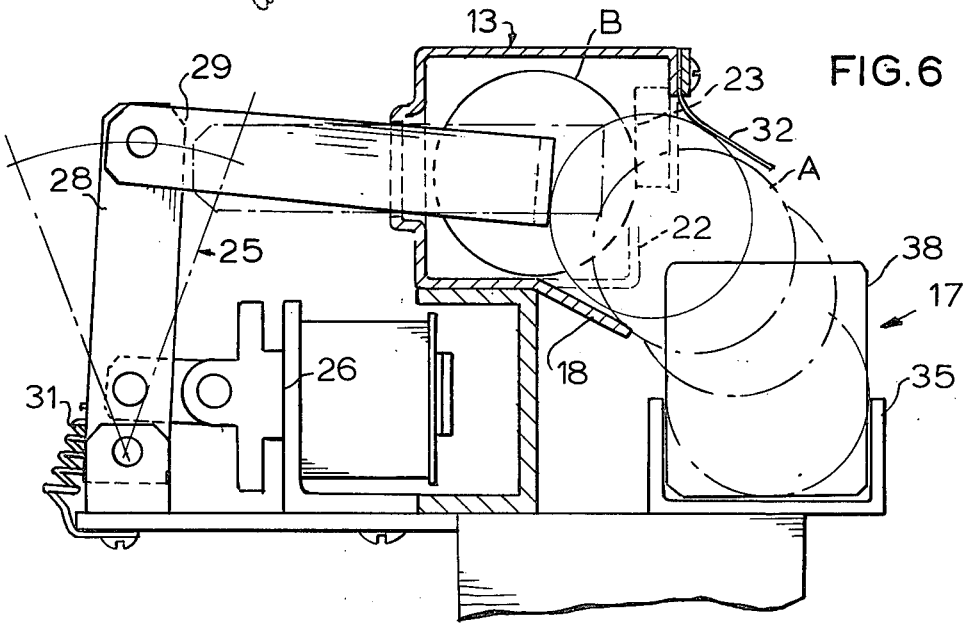
FIG. 6 is a cross-sectional view taken along the lines VI—VI of FIG. 5.

An ejector mechanism 25 is mounted within the housing 11 on the other side of the feed chute 13 from the crushing station. With reference to FIGS. 2 and 6, the ejector assembly comprises an electric solenoid piston cylinder device 26, the piston portion of which is connected to one end of an articulated crankarm 27 having pivotally connected links 28 and 29. The free end of the crankarm 27 is formed with a plunger head 30 disposed for transverse lateral movement within the bottom end of the feed chute 13. The piston of the solenoid motor assembly 26 is biased under the influence of a spring connection 31 in a direction away from the cylinder, causing the crankarm plunger 30 to normally remain at rest in a fully retracted position clear of the can-receiving interior space in the chute ejection end.

As further shown in FIGS. 2 and 6, a free hanging flap 32 preferably made of flexible material, such as plastic, is disposed across the chute sidewall facing the crushing station 17 at the lower end of the chute. The flap 32 occupies a substantial portion of a discharge opening 33 formed in the chute between the free end of the angled plate 18 and the chute upper wall. The discharge opening 33 enables a can to pass as the result of the ejection movement of the crankarm plunger 30 from the chute into the discharge station 17. The flap 32 serves to temporarily support a can in the lower end of the chute 13 until the ejector mechanism 25 is actuated, whereupon transverse movement of the can pivots the flap 32 back out of the opening 33 so the can can drop into the crushing station 17.

Shown in solid lines in FIG. 2 is the normal retracted position of the ejector mechanism 25. Within the feed chute 13 shown in phantom lines are a can A located in the ejection area at the lower end of the chute 13 and a can B immediately above can A still in the guidetrack 22 and disposed offline from the can A to be ejected. The plunger 30 is fully retracted under the influence of the crankarm return spring 31 out of the chute ejection area. Can A is poised on the upper end of the angled plate 18 and prevented from falling through the discharge opening 33 out of the chute by the side flap 32.

As shown in FIG. 6, when the ejector mechanism solenoid motor is engaged, the crankarm 27 is drawn by movement of the solenoid piston toward the cylinder causing the plunger 30 to pass transversely through the feed chute. This movement causes the plunger 30 to engage can A and force it through the hanging flap 32. The can A is thus able to travel along the angled plate 18 and fall out of the chute 13 into the crushing station 17. When the crankarm plunger 30 is again retracted, the entire stack in the chute indexes one can length downward so that the next can B is positioned in the chute bottom end to await ejection.

As shown in FIGS. 1 and 3, the crushing station 17 includes a trough-shaped bottom wall 35 open from above for receiving the can ejected from the feed chute 13. The trough 35 terminates at a free end short of the base wall 16 to define therebetween an outlet gap 36 from which crushed cans pass out of the housing 11. The other end of the trough opposed from the outlet gap 36 is closed by a longitudinally reciprocable piston 37.

The piston 37 has a piston face 38 of generally rectangular cross-section for engaging against the rear end of the can such that the can becomes longitudinally crushed as the piston moves longitudinally forward along the length of the trough 35. The piston face 38 is connected at one end of a piston rod 39, the other end of which is connected to an articulated link crankarm assembly 40 having a connecting arm 41 pivotally mounted at opposed ends and a rotating drive arm 42 pin-connected at its free end with the output shaft 43 of a rotary electric motor assembly 44.

The rotary motor 44 is preferably connected in the same energizing circuit controlled by the actuation switch 21. The circuit is supplied with electric current via a suitable on-off button 45 mounted at one end of the machine housing 11 for setting the machine 10 into operation. The motor operation is preferably intermittently triggered for revolution of the drive arm 42 in increments of one as the result of each separate triggering of the actuation switch means 21. This intermittent operation arrangement for the motor 44 means the machine 10 remains at rest until the abutment plate 19 is engaged.

Figure 4:
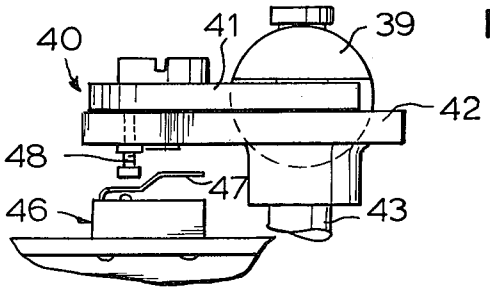
FIG. 4 is a fragmentary, cross-sectional view taken along the lines IV—IV of FIG. 3.

With reference to FIG. 4, there is shown a further actuating switch 46 which is mounted adjacent a sidewall of the housing 11 immediately beneath the crankarm assembly 40. Overlying the trigger button of the actuating switch 46 is a spring plate 47 having an upwardly stepped side profile. The spring plate 47 is fixed at one end of the actuating switch and pivotable thereabout. An adjustable abutment screw 48 is mounted into the undersurface at the outer radial end of the drive arm 42. The upper free end of the spring plate 47 lies within the circular travel path of the abutment screw 48 on the drive arm and, when the piston rod 39 is substantially fully retracted relative to the trough 35, the head of the abutment screw 48 engages with the upper free end of the spring plate 47 camming the spring plate against the trigger button of the actuating switch 46. The abutment screw 48 connected to the drive arm 42 is adjustably mounted to compensate for variations in tolerance and, thus, assure proper engagement with the spring plate 47 for proper periodic triggering of the actuation switch 46.

The actuation switch means 21 and further actuation switch 46 are connected in an electrical control circuit for producing operation of the machine 10. Before the actuation switch 21 is engaged by a can reaching the ejection end of the feed chute 13, the piston 37 is substantially fully retracted in the trough 35 and a can about to be crushed is contained in the trough. When the switch 21 is engaged, the piston motor 44 is activated, rotating the crankarm assembly 44 and causing the piston 37 to complete one to and fro stroke in the crushing station 17. Just after the piston 37 completes its retraction stroke, the drive arm 42 engages the actuating switch 46 which causes the solenoid 26 to be briefly activated. The solenoid causes the crankarm 27 toward the ejection area making the plunger 30 quickly pass laterally into the feed chute for ejection of the can there into the trough 35 of the crushing station 17. The spring retracts the plunger 30 as soon as the solenoid piston is fully attracted in its cylinder, clearing the ejection end of the chute for the next can in the stack to pass to the lower end of the chute for subsequent ejection into the crushing station 17. The process then repeats when the abutment plate 19 of the actuation switch 21 is engaged by the next arriving can in the stack.

After the actuating switch 46 is triggered by the screw 48 connected to the piston crankarm assembly 40, the motor 44 is de-activated. Acting as a further brake to movement of the piston 37 is the can ejected into the trough 35 from the chute discharge opening 33. Thus, the piston 37 is stopped, after having completed one full back and forth stroke, with the piston face 38 slightly forward along the trough 35 and abutting against the adjacent end of the can deposited in the crushing station. The crushing station motor 44 remains at rest with the piston 37 retracted until the feed chute actuation switch 21 is again engaged.

Figure 5:
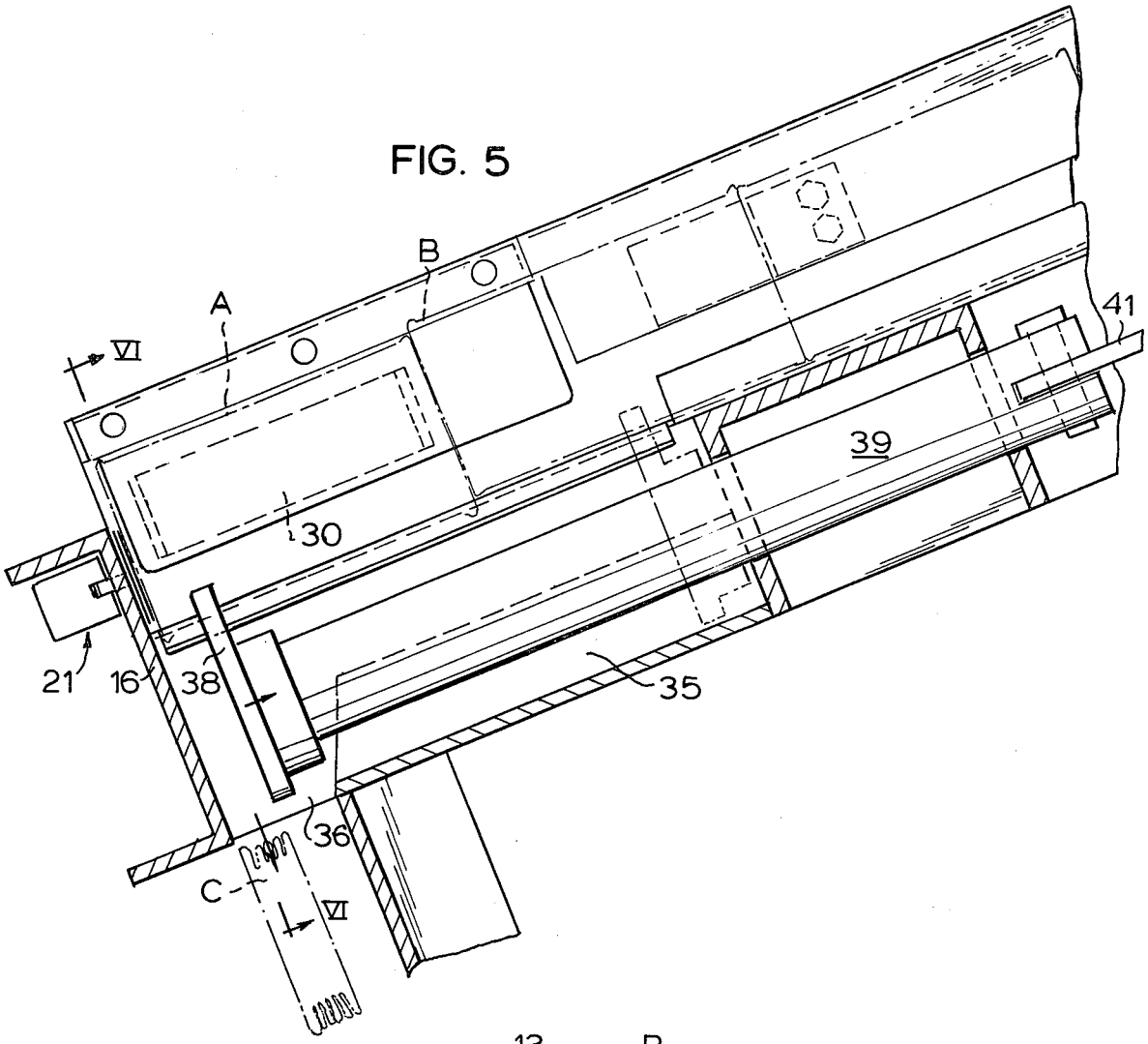
FIG. 5 is a fragmentary, cross-sectional side elevational view of the machine shown in FIG. 1 immediately after the crushing of a can.

As the crushing piston 38 is passed along the trough 35, it compresses the aluminum can therein. Extension of the crushing piston 38 causes the can to be longitudinally compressed against the base wall 16 to approximately one-eighth of its original length. As the crushing piston 38 begins its retraction stroke, as shown in FIG. 5, the crushed can product C is no longer held against the base wall 16 and falls under gravity through the outlet gap 36 into a suitable disposal receptacle (not shown), such as a plastic bag or the like.

The can crushing machine 10 of the present invention is energized for controlled operation when the on/off button 45 is switched on. Back and forth movement of the crushing piston 38 in the crushing station 17 and the plunger 30 of the ejector mechanism 25 are preferably dependent on the sequential operation of the actuating switch means 21 and 46. The automatic gravitational indexing of cans down the feed chute 13 enables a plurality of cans to be crushed without restarting the machine. In order to bring about continuous crushing of aluminum cans, the feed chute 13 must be periodically fed with spent aluminum cans so that a supply stack of cans to be crushed is formed therein. When the last can in the feed chute has been ejected into the crushing station and has been crushed, the machine 10 ceases movement and can be switched off until further use.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for the automatic crushing of spent cans comprising:

an inclined feed chute having an upper end inlet and a lower ejection end for containing a serial, contiguous stack of cans longitudinally disposed end-to-end with one another such that cans in said feed chute pass gravitationally downward to said ejection end along a first longitudinal axis, a laterally directed discharge opening formed in said ejection end, an angled bottom wall in said ejection end for supporting the bottom can in said stack with its linear axis coaxial with a second longitudinal axis spaced laterally closer to said discharge opening than said first longitudinal axis, spring means engagingly biasing the next adjacent can from the bottom can in said stack into coaxial linear axis alignment with said first longitudinal axis in said feed chute while enabling said bottom can to freely pass gravitationally downward at any time, a crushing station adjacent said discharge opening including a reciprocable piston means adapted for controlled back and forth longitudinal movement in said crushing station, an ejector means including a plunger adapted for controlled back and forth movement within said ejection end toward and away from said discharge opening for correspondingly passing the bottom can in said stack through said discharge opening into said crushing station and enabling the next can in said stack to index into said ejection end, such that the bottom can passes laterally out of said feed chute without nesting interference with the next adjacent can, and an outlet gap formed in said crushing station through which crushed cans gravitationally exit the crushing station during the retraction stroke of said piston means.

2. The apparatus of claim 1, further comprising a flexible flap disposed across said discharge opening to support the ejection end can along said second longitudinal axis until ejected through said discharge opening.

3. The apparatus of claim 1, wherein said ejection end is formed with a trigger plate connected to an actuation switch means, said trigger plate being adapted to be depressed by the can entering said ejection end to engage said actuation switch means, and said actuation switch means being drivingly connected to said piston means.

4. The apparatus of claim 3, further comprising a further actuation switch means adjacent said piston means for being triggered when said piston means is being retracted in said crushing station, said further actuation switch being connected to said ejector means for causing said plunger to move toward said discharge opening when said further actuation switch means is triggered.

5. The apparatus of claim 4, wherein said ejector means comprises a one-way solenoid piston motor drivingly connected to said plunger for movement thereof toward said discharge opening and a return spring means connected to said solenoid piston motor for movement of said plunger away from said discharge opening, said solenoid piston motor operating upon engagement of said further actuation switch means.

6. The apparatus of claim 4, wherein said piston means includes a rotary motor, a reciprocable piston, and a crankarm means drivingly connected between said rotary motor and said piston, and said further actuation switch means includes a resilient plate adapted for periodic engagement by said crankarm to trigger said further actuation switch means.

7. The apparatus of claim 6, further comprising a screw adjustably mounted in the crankarm means for abutting with said resilient plate to trigger said further actuation switch means.

8. The apparatus of claim 1, wherein each can crushed in said crushing station is longitudinally compressed to about one-eighth its original longitudinal length.

9. The apparatus of claim 1, wherein the cans being crushed are twelve-ounce, aluminum cans.

10. The apparatus of claim 1, wherein said inlet is provided with a conttol ring having a central hole of predetermined diameter such that oversized or twisted cans are prevented from passing into said inlet.

* * * * *